US006026528A

United States Patent [19]

Pina

[11] Patent Number: 6,026,528

[45] Date of Patent: Feb. 22, 2000

[54] FRAME

[75] Inventor: Lynn M. Pina, Pawtucket, R.I.

[73] Assignee: The First Years Inc., Mission Viejo, Calif.

[21] Appl. No.: 09/120,930

[22] Filed: Jul. 22, 1998

[51] Int. Cl.[7] ..... A47C 31/00

[52] U.S. Cl. ..... 5/658; 5/503.1; 5/908; 5/946; 40/727; 40/617

[58] Field of Search ..... 446/227; 40/727, 40/725, 746, 754, 755, 750, 757, 610, 617, 717; 5/658, 503.1, 908, 946, 93.1, 424

[56] References Cited

U.S. PATENT DOCUMENTS

| | | | |
|---|---|---|---|
| 3,978,532 | 9/1976 | Scheiner | 5/93 |
| 4,393,612 | 7/1983 | Clark | 40/798 |
| 4,541,190 | 9/1985 | Weiner et al. | 40/610 |
| 4,934,078 | 6/1990 | Sloot | 40/754 |
| 4,968,279 | 11/1990 | Smith | 446/227 |
| 5,172,503 | 12/1992 | Dane et al. | 40/757 X |
| 5,253,439 | 10/1993 | Shanok et al. | 40/746 X |
| 5,359,374 | 10/1994 | Schwartz | 40/717 X |
| 5,410,765 | 5/1995 | Dicken | 5/946 X |
| 5,499,465 | 3/1996 | Manico | 40/717 |
| 5,533,290 | 7/1996 | Lee et al. | 40/717 |
| 5,706,534 | 1/1998 | Sherman | 5/424 |
| 5,802,634 | 9/1998 | Onishi et al. | 40/727 X |
| 5,806,112 | 9/1998 | Harms | 5/93.1 |

OTHER PUBLICATIONS

Lamaze Infant Development System, copies of product packaging, Learning Curve Toys® ©1996.

Crib Mirror, copies of product packaging, Item #154–200, Infantino, Inc. ©1996.

Lights & Lullaby, copies of product packaging, Summer Infant Products, Inc. (Date unknown).

Reversible Crib Mirror, copies of product packaging, Product #73702, Fisher–Price, Inc. ©1995.

First Impressions Baby Mirror, copies of product packaging, NoJo® (Date unknown).

*Primary Examiner*—Brian K. Green
*Assistant Examiner*—Rodrigo J. Morales
*Attorney, Agent, or Firm*—Fish & Richardson P.C.

[57] ABSTRACT

An apparatus, adapted to be attached to a crib having a mattress, includes includes a frame configured to receive and hold an object while allowing the object to be seen, fasteners connected to the frame and adapted to releasably secure the frame to the crib above the mattress, and a depending member connected to the frame and having a length sufficient to extend underneath the mattress from the frame when the frame is secured to the crib by the fasteners.

4 Claims, 5 Drawing Sheets

FRAME

BACKGROUND OF THE INVENTION

The invention relates to a frame for a mirror, picture or the like and, more particularly, to a frame for hanging from a crib or for mounting on a flat surface.

Mobiles and other aesthetically pleasing devices are often placed within view of a child when in a crib or a play area, e.g., on a floor. These devices are provided to satiate and entertain the child. Some of these devices can be mounted to the side of the crib, such as on a railing of the crib. As with any item used for children, safety of these devices is a primary concern.

SUMMARY OF THE INVENTION

In general, in one aspect, the invention provides an apparatus adapted to be attached to a crib having a mattress, the apparatus comprising a frame configured to receive and hold an object while allowing the object to be seen, fasteners connected to the frame and adapted to releasably secure the frame to the crib above the mattress, and a depending member connected to the frame and having a length sufficient to extend underneath the mattress from the frame when the frame is secured to the crib by the fasteners.

Implementations of the invention may include one or more of the following. The depending member can have a length of at least about 12 inches. The depending member can comprise a flexible material. The apparatus can further comprise a stiffener member connected to a portion of the depending member displaced from the frame. The frame can include a first fastener mounted on a back surface of the frame, a first end of the depending member can be hingedly connected to the frame and the stiffener member can be disposed within the depending member near a second end, and the depending member can include a second fastener disposed near the second end of the depending member and adapted to couple to the first fastener. The first fastener can be adapted to couple to the second fastener at a plurality of heights along the back surface of the frame. The frame can comprise a pad enclosed by a flexible fabric.

In general, in another aspect, the invention provides an assembly adapted to be mounted to a crib, having a mattress, or on a flat surface, the assembly comprising a soft frame configured to receive and hold a planar object and to allow the object to be seen, a first fastener mounted to a back side of the frame, a plurality of straps connected near a top end of the frame, an apron attached to the frame and having a length sufficient to extend between a side of the crib and the mattress when the assembly is attached to the crib by the straps, a stiffener disposed within a portion of the apron, the stiffener being displaced from the frame, and a second fastener connected to the apron near an end of the stiffener and adapted to couple to the first fastener.

Embodiments of the invention may provide one or more of the following advantages. A mirror or other object can be mounted to a crib railing or on a flat surface. A child can be inhibited from getting, e.g., an arm or a leg, caught between a crib wall or post and a mattress. A mirror or other object can be tilted at several angles relative to a surface on which it is mounted.

DESCRIPTION OF PREFERRED EMBODIMENTS

Figure 1:
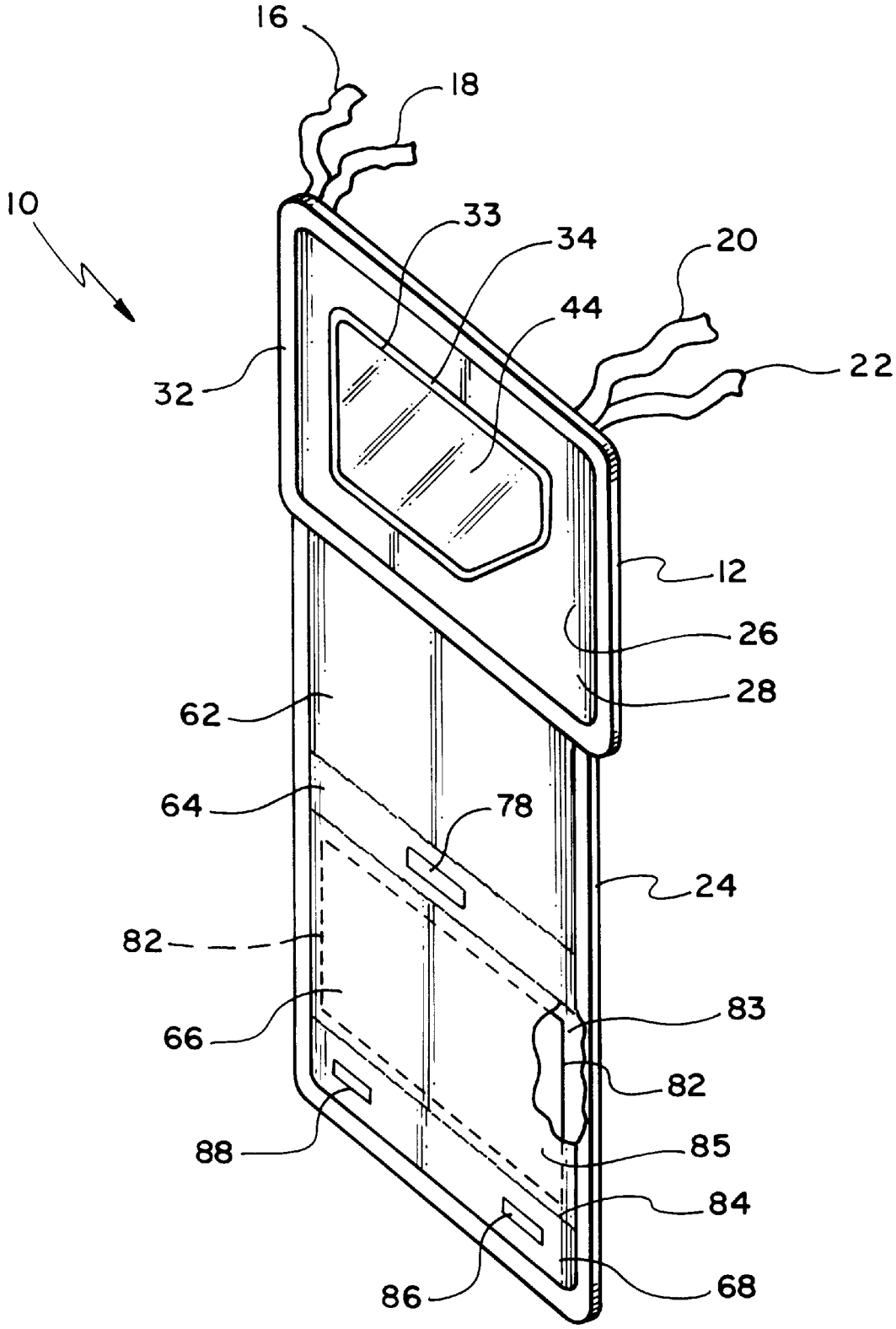
FIG. 1 is a perspective view of a front side of an apparatus for holding, e.g., a mirror.

As shown in FIG. 1, an apparatus 10 for holding, e.g., a mirror, and mounting to a crib or on a flat surface includes a frame 12 holding a mirror 44, four straps 16, 18, 20, and 22, and an apron 24. Apparatus 10 is adapted for use with a child and to be mounted to a crib and on a flat surface. To be pleasing to a child, a front face 26 of frame 12 can be decorated appropriately, e.g., with animals. Outer surfaces of apparatus 10 are made from soft materials. Apparatus 10 comprises several panels that are made of a foam material enclosed by two fabric sheets made of a polyester and cotton blend. The foam material is bonded to one of the sheets and is enclosed in the sheets by sewing the sheets together.

Figure 2:
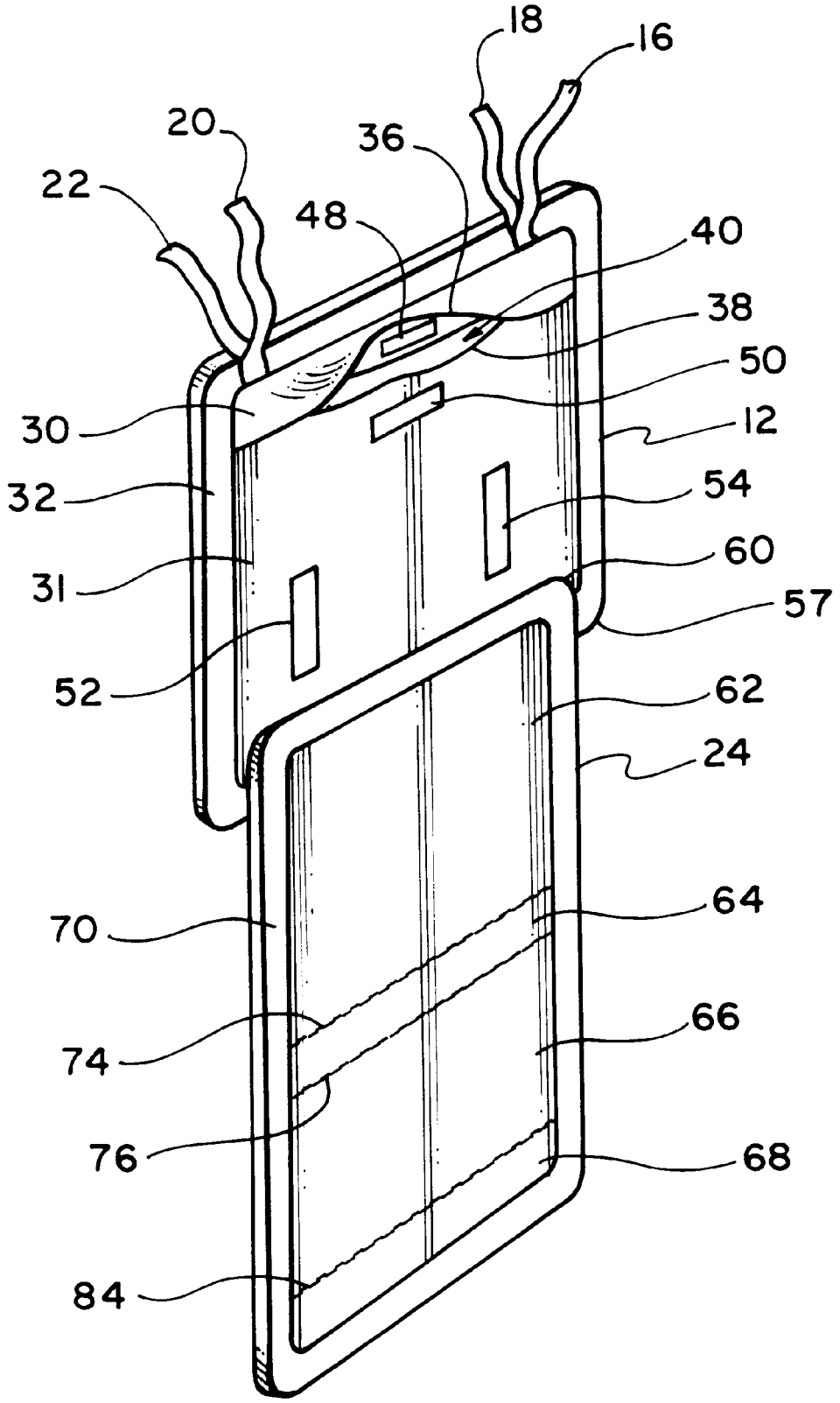
FIG. 2 is a perspective view of a back side of the apparatus shown in FIG. 1.

Referring also to FIG. 2, frame 12 includes a front panel 28, an upper rear panel 30, and a lower rear panel 31. Frame 12 is about 10 inches wide and 7.5 inches high, and has a bias binding 32 stitched about its perimeter connecting front panel 28 to rear panels 30 and 31. Bias binding 32 provides about a ¼" border around frame 12 and is made, e.g., from a polyester and cotton blend sheet fabric having a different color than front panel 28, upper rear panel 30, and lower rear panel 31. Another border 34 is stitched around an opening or window 33 of front panel 28 and is made of, e.g., the same fabric as binding 32, and has a small width (forming a "piping"). Opening 33 is about 6 inches wide and 4.25 inches high.

Straps 16, 18, 20, and 22 are attached to upper rear panel 30. Straps 16, 18, 20 and 22 are grouped in pairs, as shown, near the top of frame 12. The group including straps 16 and 18 is displaced from the group including straps 20 and 22 along the length of frame 12. Straps 16, 18, 20, and 22 are made of flexible material, such as a polyester and cotton blend fabric or woven nylon, and are long enough so that strap 16 can be tied to strap 18 around a railing of a crib, and likewise for straps 20 and 22.

Attached to lower rear panel 31 are two loop-type fastener strips 52 and 54. Fastener strips 52 and 54 are displaced along a width of lower rear panel 31, and are adapted to be coupled to by mating fasteners at multiple points along their lengths. Here, strips 52 and 54 are strips of loop-type fastening material.

Rear panels 30 and 31 are connected to front panel 28 to form a pocket 40. Upper rear panel 30 is connected to front panel 28 along three edges and has a free edge 36. Lower rear panel 31 is also connected to front panel 28 along three edges and has a free edge 38. Panels 28, 30, and 31 form pocket 40 that is accessible by separating free edges 36 and 38 of panels 30 and 31, respectively. Upper rear panel 30 overlaps lower rear panel 31. An inside surface of upper rear panel 30 has a hook-type fastener 48 and lower rear panel 31 has a loop-type fastener 50 disposed to fasten to fastener 48 to selectively couple panel 30 to panel 31 to close pocket 40. Pocket 40 is adapted to receive a mirror assembly 42 (see FIG. 3 and discussion below) including mirror 44, or another object, such as a picture. Here, pocket 40 is shaped to receive a generally planar object. Opening 33 is disposed and shaped to allow mirror 44 to be seen from the front of frame 12.

Figure 3:
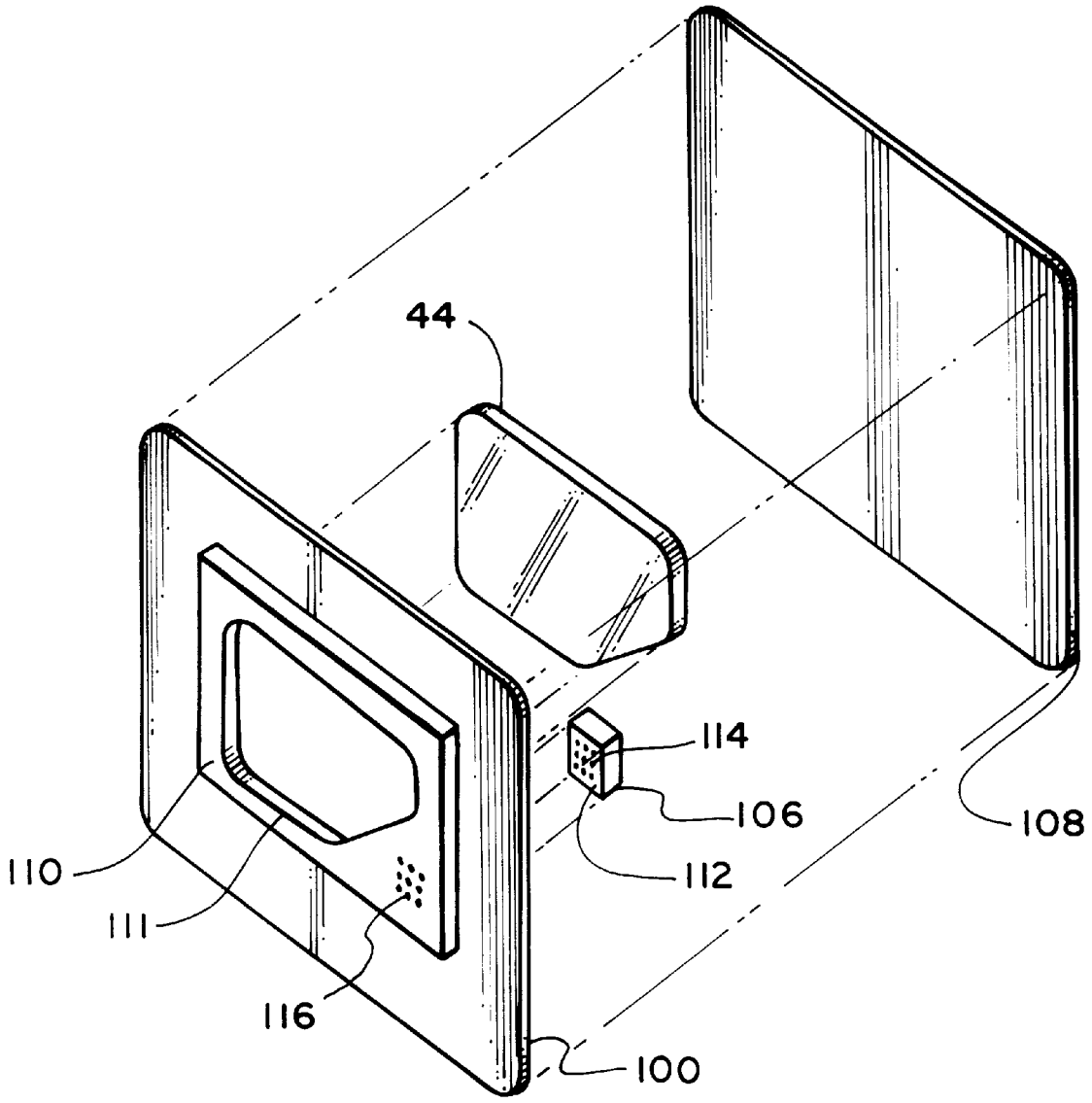
FIG. 3 is an exploded view of a mirror assembly.

As shown in FIG. 3, mirror assembly 42 includes a front liner 100, mirror 44, an electronic audio device 106, and a rear liner 108. Liners 100 and 108 are made of, e.g., styrene such as ABS. Front liner 100 includes a raised region 110 so that front liner 100 can receive mirror 44 and device 106. Liner 100 also includes an opening 111 so that mirror 44 can be seen. Device 106 is adapted to be actuated to play music in response to being pressed. A front cover 112 protects device 106 while allowing sound to emanate through holes 114. Holes 116 are provided in front liner 100 to help sound from device 106 emanate from apparatus 10.

Returning to FIGS. 1 and 2, apron 24 includes a top panel 62, a middle panel 64, a bottom panel 66, and a flap panel 68. Apron 24, like frame 12, includes a bias binding 70 about ¼" wide around its perimeter. A top end 60 of top panel 62 is hingedly attached, e.g., by stitching, to lower rear panel 31 near a bottom end 57. Top panel 62 extends across substantially the entire width of frame 12, and extends away from frame 12 a width of approximately seven inches. The width of top panel 62 is selected to be at least as wide as a typical crib mattress is thick. Middle panel 64 is bounded by stitches 74 and 76 separated by about two inches, and hingedly connects top panel 62 to bottom panel 66. A front side of middle panel 64 includes a loop-type fastener 78 disposed and adapted to mate with hook-type fastener 48 when apron 24 is folded appropriately.

Bottom panel 66, as shown partially removed in FIG. 1, contains a stiffener 82. Stiffener 82 is disposed between two fabric sheets 83 and 85 of panel 66. Stiffener 82 is substantially rigid and made of, e.g., polypropylene. Bottom panel 66 has a width substantially equal to the combined widths of top panel 62 and middle panel 64.

Flap 68 is hingedly attached to bottom panel 66 by, e.g., stitching 84, and includes two fastener strips 86 and 88 disposed and adapted to mate with fasteners strips 52 and 54, respectively. Fastener strips 86 and 88 are hook-type fasteners aligned with fastener strips 52 and 54 on lower rear panel 31.

Apparatus 10 can be assembled as follows. Liners 100 and 108 are attached, e.g., by sonic welding, to secure mirror 44 and device 106 between liners 100 and 108. Fasteners 48, 50, 52, 54, 78, 86, and 88 are sewn to sheet fabric. Panels 28, 30, 31, 62, 64, 66 and 68 are formed by bonding foam to sheet fabric, and enclosing the foam in sheet fabric and sewing the sheet fabric around the foam, and sewing bias binding 70 around the perimeter of apron 24. For panel 66, stiffener 82 is also enclosed by the sheet fabric. Front panel 28, and rear panels 30 and 31 are sewn together with binding 32. Straps 16, 18, 20, and 22 are sewn to frame 12. Apron 24 is sewn to frame 12.

In use, apparatus 10 can be mounted to a crib or a flat surface.

Figure 4:
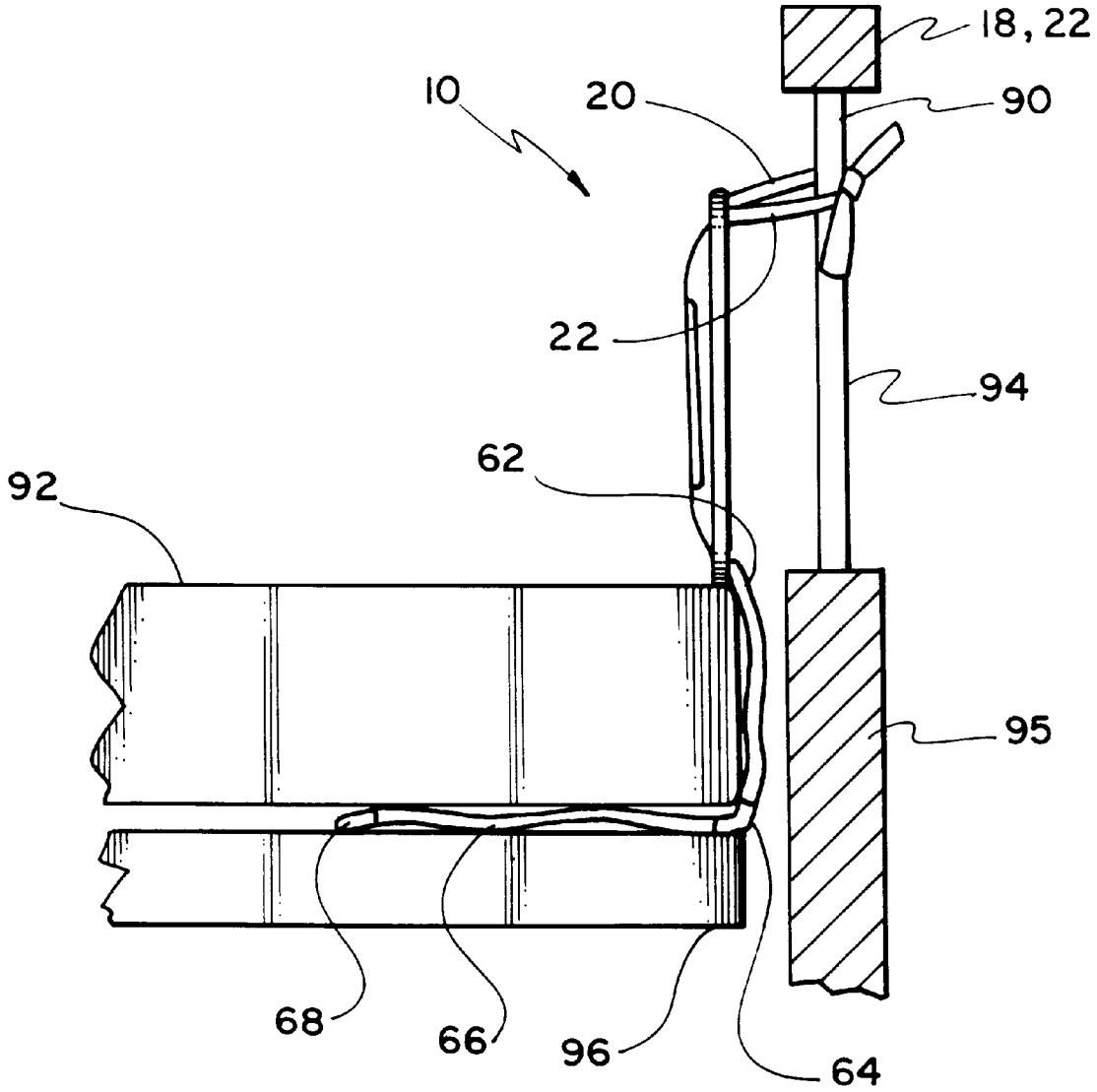
FIG. 4 is a schematic side view of the apparatus shown in FIG. 1 attached to a crib.

As shown in FIG. 4, to attach apparatus 10 to a crib, straps 20 and 22 are tied together around a rail or post 90 of a crib, and straps 16 and 18 (not shown in FIG. 4) are similarly tied. Frame 12 is disposed such that a child placed on a mattress 92 in the crib can see her/his reflection in mirror 44 through openings 33 and 111. Apron 24 is inserted between posts 94 (only one is shown) and bed frame 95 on one side and mattress 92 on the other, and between mattress 92 and box spring 96. As shown, top panel 62 lies between bed frame 95 and mattress 92, middle panel 64 is bent to allow bottom panel 66, including stiffener 80 (FIG. 1), and flap 68, to be sandwiched between box spring 96 and mattress 92. In this position, apron 24 guards against a child's appendage, e.g., an arm or a leg, getting inserted and stuck between mattress 92 and bed frame 95, which could cause, among other problems, loss of circulation. Top panel 62 is preferably sized so that at least bottom panel 66 can be at least partially inserted between mattress 92 and box spring 96. Top panel 62 may be long enough to partially extend underneath mattress 92.

Figure 5:
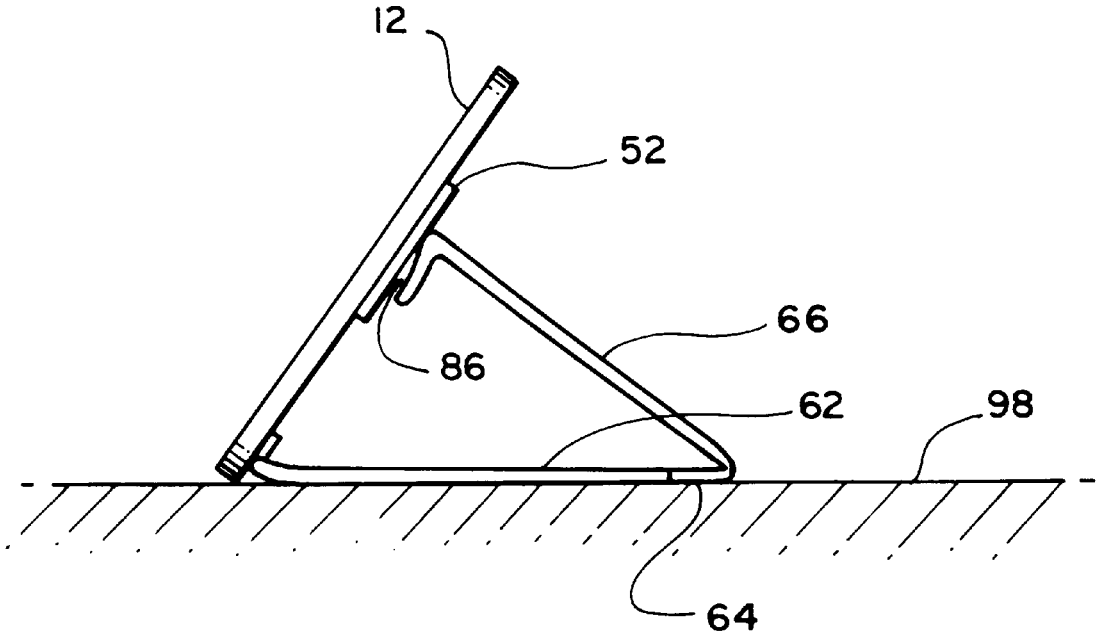
FIG. 5 is a schematic side view of the apparatus shown in FIG. 1 mounted on a flat surface.

As shown in FIG. 5, to mount apparatus 10 to a flat surface 98, apron 24 is bent and attached to frame 12 to support frame 12. Top panel 62 is placed on surface 98 and bottom panel 66 extended toward the rear of frame 12. Fastener strips 86 and 88 (not shown in FIG. 5) on flap 68 are connected to mating fastener strips 52 and 54 (not shown in FIG. 5) on the rear of frame 12. The location at which strips 86 and 88 are connected to strips 52 and 54 may be adjusted along the lengths of strips 52 and 54 to alter the angle of frame 12 relative to surface 98. Although surface 98 is shown as being flat, apparatus 10 can be similarly mounted on other surfaces that are not flat.

Figure 6:
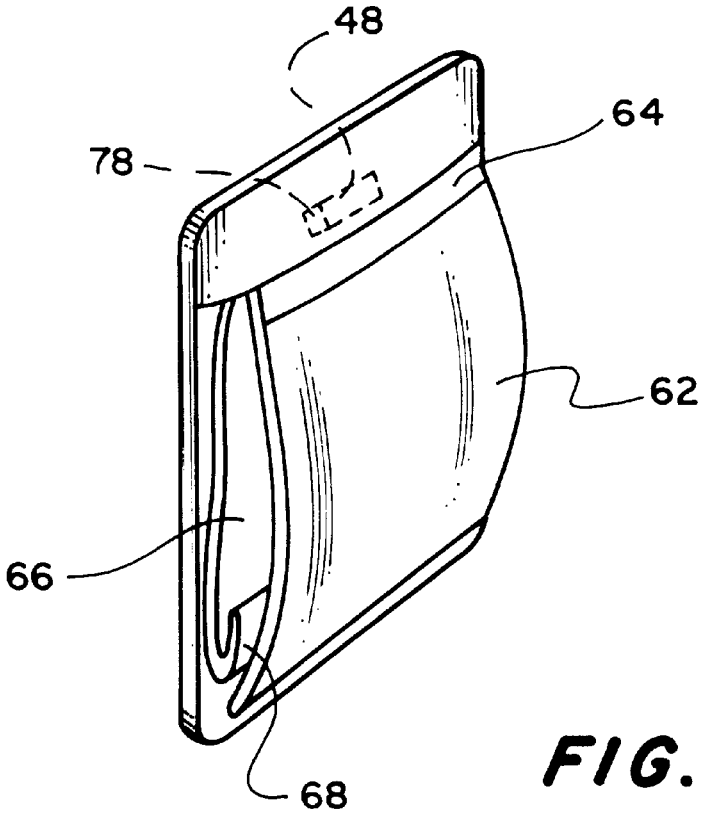
FIG. 6 is a schematic perspective view of the apparatus shown in FIG. 1 in a compact orientation.

As shown in FIG. 6, apparatus 10 can be secured in a compact position for, e.g., storage. Flap 68 is folded toward the rear surface of bottom panel 66. Bottom panel 66 is folded toward the rear surface of top panel 62 about stitching 76 (not shown in FIG. 6). Top panel 62 is folded toward lower rear panel 31 and tucked under upper rear panel 30. Loop-type fastener 78 is mated with hook-type fastener 48 of upper rear panel 30.

Other embodiments are within the scope of the invention. For example, some or all of the panels, e.g., panels 62, 64, 66, and 68 may not include foam.

What is claimed is:

1. An apparatus adapted to be attached to a crib having a mattress, the apparatus comprising:

a frame configured to receive and hold an object while allowing the object to be seen;

fasteners connected to the frame and adapted to releasably secure the frame to the crib above the mattress;

a depending member connected to the frame and having a length sufficient to extend underneath the mattress from the frame when the frame is secured to the crib above the mattress using the fasteners; and a stiffener member connected to a portion of the depending member displaced from the frame; wherein the frame includes a first additional fastener mounted on a back surface of the frame, a first end of the depending member is hingedly connected to the frame and the stiffener member is disposed within the depending member near a second end, and wherein the depending member includes a second additional fastener disposed near the second end of the depending member and is adapted to couple to the first additional fastener.

2. The apparatus of claim 1 wherein the first additional fastener is adapted to couple to the second additional fastener at a plurality of heights along the back surface of the frame.

3. The apparatus of claim 1 wherein the first additional fastener is mounted to the frame along a length of the back of the frame.

4. An assembly adapted to be mounted to a crib, having a mattress, or on a flat surface, the assembly comprising:

a soft frame configured to receive and hold a planar object and to allow the object to be seen;

a first fastener mounted to a back side of the frame;

a plurality of straps connected to the frame near a top end of the frame;

an apron attached to the frame and having a length sufficient to extend between a side of the crib and the mattress and underneath the mattress when the frame is attached to the crib above the mattress by the straps;

a stiffener disposed within a portion of the apron, the stiffener being displaced from the frame; and a second fastener connected to the apron near an end of the stiffener and adapted to couple to the first fastener.

* * * * *